United States Patent [19]

Oberdorf

[11] Patent Number: 4,648,235

[45] Date of Patent: Mar. 10, 1987

[54] APPARATUS FOR FEEDING CIGARETTES TO A PACKAGING STATION

[75] Inventor: Manfred Oberdorf, Gevelsberg, Fed. Rep. of Germany

[73] Assignee: Maschinenfabrik Alfred Schmermund GmbH, Gevelsberg, Fed. Rep. of Germany

[21] Appl. No.: 796,706

[22] Filed: Nov. 12, 1985

[30] Foreign Application Priority Data

Nov. 22, 1984 [DE] Fed. Rep. of Germany ..... 3442462

[51] Int. Cl.[4] ..... B65B 57/06

[52] U.S. Cl. ..... 53/54; 53/151; 221/224; 221/251; 221/266

[58] Field of Search ..... 53/54, 148, 149, 150, 53/151, 152, 236, 247; 209/535; 221/211, 224, 236, 251, 266; 198/347, 397, 532, 550.4; 131/282; 4/4

[56] References Cited

U.S. PATENT DOCUMENTS

| | | | |
|---|---|---|---|
| 3,324,622 | 6/1967 | Schmermund | 53/148 |
| 3,603,445 | 9/1971 | Zausch | 53/149 |
| 4,376,484 | 3/1983 | Seragnoli | 20 '535 |

FOREIGN PATENT DOCUMENTS

| | | | |
|---|---|---|---|
| 100537 | 2/1984 | European Pat. Off. . | |
| 478307 | 6/1929 | Fed. Rep. of Germany | 53/148 |
| 2098971 | 12/1982 | United Kingdom | 53/148 |

*Primary Examiner*—John Sipos
*Assistant Examiner*—Donald R. Studebaker
*Attorney, Agent, or Firm*—Prutzman, Kalb, Chilton & Alix

[57] ABSTRACT

Cigarettes are transferred by a rotatable device from the exit ends of guide channels in a receiving funnel to a device which arranges the cigarettes in layers for subsequent formation of cigarette blocks to be wrapped. The rotatable transfer device consists of a drum provided with spaced groups of cigarette receiving grooves on its periphery, the receiving funnel and the layer-forming device being generally oppositely situated with respect to the drum and being vertically separated whereby gravity feed to and discharge from the drum may be effected. A mechanism for insuring that cigarettes will be fed from the receiving means to all of the grooves of each group on the drum at the same time is associated with the drum.

18 Claims, 4 Drawing Figures

APPARATUS FOR FEEDING CIGARETTES TO A PACKAGING STATION

BACKGROUND OF THE INVENTION

I. Field of the Invention

The present invention relates to the information of cigarette packages and particularly to the transfer of completed cigarettes to packaging apparatus with inspection and rejection of defective cigarettes during the transfer procedure. More specifically, this invention is directed to apparatus for delivering completed cigarettes to a packaging station, the apparatus detecting and ejecting defective cigarettes. Accordingly, the general objects of the present invention are to provide novel and improved methods and apparatus of such character.

II. Description of the Prior Art

Apparatii for feeding unpackaged cigarettes to a packaging station of a cigarette packaging machine are known in the art. An exemplary prior art cigarette feed apparatus is disclosed in published European application No. 0,100,537. This exemplary prior art cigarette feed apparatus has a delivery shaft which is subdivided into individual guide channels by partitions. A sensor for checking cigarette qualify is associated with each guide channel. A transfer roller, provided with a pair of oppositely disposed cigarette receiving troughs or grooves in its periphery, is positioned in registration with the exit end of each guide channel. The cigarettes move along the guide channels under the influence of gravity and are subsequently individually transferred by the rollers to further guide or delivery channels. An ejector, which may be in the form of an air blast, is positioned to remove defective cigarettes from each roller during the rotation thereof, i.e. the defective cigarettes will be blown out of the receiving troughs in the rollers and thus will not reach the further guide channels through which the cigarettes are delivered to the packaging station.

Continuing to discuss exemplary prior art apparatus such as disclosed in the above-referenced European application, the layers of cigarettes which will define a cigarette block to wrapped are formed at the end of the further guide channels. There must, accordingly, always be sufficient cigarettes in the lower portions of the further guide channels to form a complete layer. Since defective cigarettes occur variably in the guide channels, it is necessary to exercise control over the transfer rollers individually to ensure that all of the further guide channels will be populated with a sufficient number of acceptable cigarettes. This requires relatively sophisticated control hardware and results in comparatively complex and expensive apparatus. This control hardware includes filling-level indicators for sensing the presence of an adequate supply of cigarettes in the further guide channels and for controlling the rotational speed of the transfer rollers associated with each guide channel. Even with such comparatively complex apparatus, operational problems have been known to occur when several defective cigarettes occur in succession in a given guide channel.

SUMMARY OF THE INVENTION

The present invention overcomes the above-briefly discussed and other deficiencies and disadvantages of the prior art by providing a novel technique for the simultaneous inspection of and transfer of cigarettes to a packaging station. The present invention also encompasses apparatus for use in the practice of this novel technique which is characterized by uncomplicated and thus reliable construction, the apparatus guaranteeing the delivery of sufficient quantities of acceptable cigarettes to the packaging station.

Apparatus in accordance with the preferred embodiment of the present invention includes a feed shaft which is divided into individual elongated guide channels. A quality sensor is associated with each channel. The guide channels terminate adjacent and in vertical alignment with the periphery of a common transfer drum or wheel which is rotatable in steps. The transfer wheel is provided on its periphery with groups of receiving grooves which are spaced so as to be alignable with the exit ends of the guide channels. A retention or blocking device is provided for closing the exit ends of the guide channels during rotation of the transfer wheel. The apparatus also includes means for ejecting defective cigarettes at a location displaced from the exit ends of the group of guide channels. This permits defective cigarettes to be ejected during a period of time when the transfer wheel is stationary. A receiving funnel, which provides communication to a further or downstream array of guide channels, is positioned to receive cigarettes of acceptable quality from the transfer wheel.

In accordance with a second embodiment of the invention, the transfer wheel is horizontally offset from the discharge ends of the guide channels and a slide mechanism is employed to push the cigarettes in all of the guide channels horizontally into the transfer wheel when the wheel stops between steps. The second embodiment is otherwise substantially the same as the above-described preferred embodiment.

When practising the method of the present invention, employing either of the above-breifly described embodiments, groups of cigarettes are transferred from the lower ends of the guide channels into receiving grooves of a transfer wheel which is rotated intermittently. Defective cigarettes are preferabbly ejected when the transfer wheel is in a standstill position. Cigarettes which are not ejected are delivered into a funnel from which they are extracted to form the layers which define cigarette blocks which are to be wrapped. Cigarettes located at the bottom ends of the guide channels are isolated from the transfer wheel during the rotation thereof. The means which achieves this isolation includes a moveable member which is activated to transfer, or permit transfer under the influence of gravity, the lowermost cigarettes in the guide channels onto the transfer wheel substantially simultaneously.

A particularly significant advantage of the present invention is that it may be installed directly on conventional cigarette funnels by which cigarettes are delivered to a packaging station of a wrapping machine.

BRIEF DESCRIPTION OF THE DRAWING

The present invention may be better understood and its numerous objects and advantages will become apparent to those skilled in the art by reference to the accompanying drawing wherein like reference numerals refer to like elements in the several figures and in which.

DESCRIPTION OF THE DISCLOSED EMBODIMENTS

Figure 1:
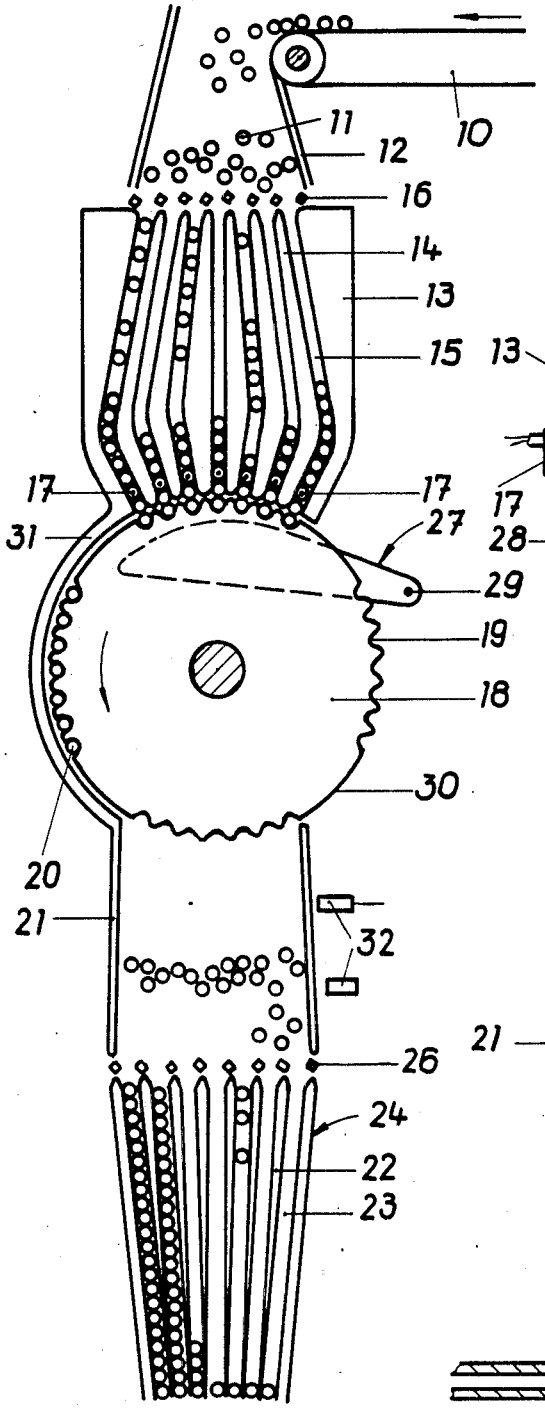
FIG. 1 is a schematic front elevational view, partly in section, of apparatus for feeding cigarettes to a packaging station of a cigarette packaging machine in accordance with the present invention.

With reference now to the drawing, in both disclosed embodiments of the invention cigarettes 11 are delivered via a feed belt 10 to a supply funnel 12, the direction of movement of the cigarettes along belt 10 being generally transversely with respect to their axes. The cigarettes fed into funnel 12 move downwardly, under the influence of gravity, to the entrance end of a shaft 13. The shaft 13 is divided into a plurality of individual guide channels 15 by partition walls 14. Each of the guide channels 15 has a width commensurate with the diameter of the cigarettes being packaged and a length which corresponds to the length of the cigarettes being packages. Accordingly, the cigarettes 11 will be arranged individually one above another in the channels 15 as shown. Plural vibrating rollers 16 are positioned at the entrance ends to the channels 15 to assist the delivery of the cigarettes into the channels. Pairs of aligned sensors 17, which extend through the side walls of shaft 13, are associated with each of guide channels 15. The sensors 17 are located just above the exit ends of the channels 15 and are positioned such that cigarettes moving down the channels will successively assume a position where they are axially in line with the sensors as may best be seen from FIGS. 2 and 4. The sensors 17 will be optical devices of a type known in the art for checking the degree of filling of the cigarettes and will provide electrical output signals commensurate with defective cigarettes.

Figure 2:
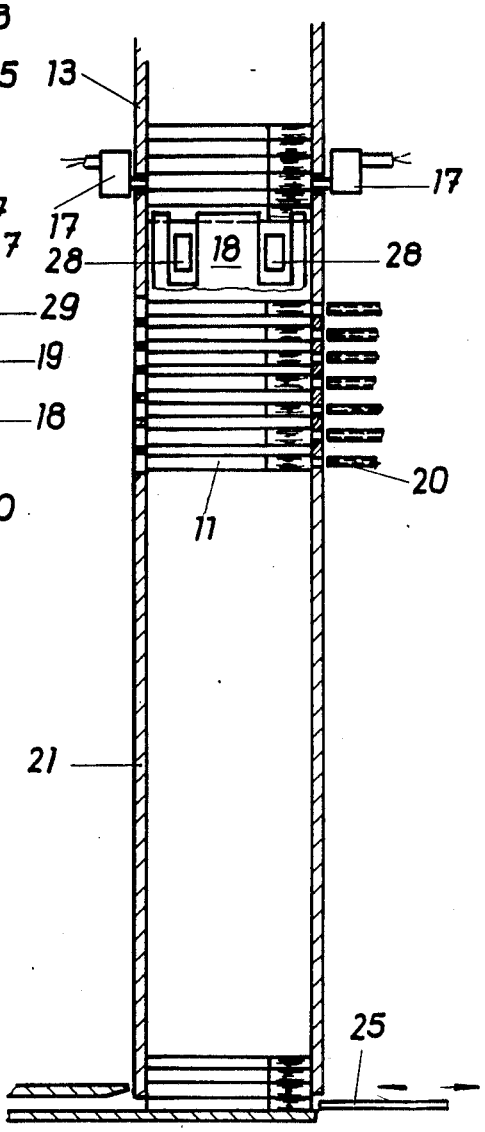
FIG. 2 is a cross-sectional side elevation view of the apparatus represented by FIG. 1.

In the embodiment of FIGS. 1 and 2, a transfer wheel 18 is located immediately beneath the shaft 13. The transition wheel 18 is provided, in its periphery, with groups of receiving grooves or troughs 19. The number of receiving grooves 19 in each group will correspond to the number of guide channels 15 in shaft 13 and the grooves 19 will be spaced apart by a distance commensurate with the spacing between the exit ends of the channels. The depth of the receiving grooves 19 corresponds to the diameter of the cigarettes 11. In the disclosed embodiments, there are four separate groups of seven receiving grooves 19. The lower end of shaft 18, which in part defines the exit ends of the channels 15, is shaped to be complimentary to the convex peripheral surface of the transfer wheel 18 whereby each cigarette passing from the shaft 13 into a groove in the transition wheel 18 will travel the same distance. The transfer wheel 18 is coupled to a stepping drive, not shown. In the disclosed embodiment, the transfer wheel 18 will be indexed in steps of 90 degrees each by the stepping drive.

In the disclosed embodiments, the transfer wheel 18 is indexed in steps of 90 degrees in the counter-clockwise direction. After one step, the last filled group of grooves 19 will be in registration with an array of ejectors 20. Through the use of logic circuitry which receives the outputs of the sensors 17, the ejectors will be selectively activated to cause the ejection of defective cigarettes from grooves 19 during the period between steps when the transfer wheel is stationary. The ejectors 20 can be mechanical push-type devices or pneumatic ejectors which employ a jet of compressed gas to blow defective cigarettes from the grooves 19.

Cigarettes which are not defective remain in the grooves 19 and, when the transfer wheel 18 has been indexed a second 90 degree step, will fall into a supply funnel 21 which is positioned beneath transfer wheel 18. Funnel 21 provides communication with a shaft 24 which, like shaft 13, is subdivided into an array of parallel guide channels 23 by means of partition walls 22. The number of guide channels 23 will typically be commensurate with the number of cigarettes which are to form the layer of a "block" to be wrapped. Also, the lower or exit ends of the channels 23 will be positioned closely adjacent to one another and arranged that the axes of the cigarettes disposed thereon will be parallel. As indicated in FIG. 2, the cigarettes will be removed layer-by-layer, from shaft 24 by a pusher-type device 25. Vibrating rollers 26 are provided at the entrance ends to the channels 23 to facilitate the even distribution and the separation of the cigarettes 11 so that they enter the guide channels 23 individually.

A filling-level controller 32 is associated with the supply funnel 21 for shaft 24. The transfer wheel 18 will be activated to deliver cigarettes to funnel 21 whenever the controller 32 senses that there are an insufficient number of cigarettes within funnel 21 to ensure adequate supply for the wrapping machine via the shaft 24. Thus, under normal operation, the supply funnel 21 will remain partly filled with cigarettes of acceptable quality.

Apparatus in accordance with the embodiment of FIGS. 1 and 2 includes a retention device which has been indicated generally and schematically at 27. The purpose of the retention device 27 is to support the lowest level of cigarettes in the plural guide channels 15 after a group of cigarettes has been transferred from the guide channels into the grooves 19 in transfer wheel 18. Accordingly, the retention device 27 functions to prevent the feed of cigarettes to the transfer wheel as it moves during steps and thus ensures that the grooves 19 are not filled successively from the first of the guide channels 15 encountered during the counter-clockwise movement of the transfer wheel. Restated, the retention device 27 guarantees that there will be transfer only from all of the channels 15 substantially simultaneously into the grooves 19 on the transfer wheel 18.

The retention device 27 may take the form of a fork-shaped lever 28 which is pivoted about a pivot pin or axle 29. The side edges of the lever 28 which cooperate with the descending cigarettes is curved so as to have a radius which approximates that of transfer wheel 18. Lever 28 is pivotal between a position in which the curved sides thereof rest against the underside of the shaft 13, and thus close the exit ends of the guide channels 15, and a position in which the lever is pivoted away from the underside of shaft 13, thus opening the exit ends of the guide channels and permitting the transfer of cigarettes from all of the guide channels into the receiving grooves 19 on transfer wheel 18. It has been found desirable to separate the groups of receiving grooves 19 from one another by a circular arc, as indicated at 30, having a length which corresponds to the length of that portion of a circle which encompasses a group of the receiving grooves 19. If the arcuate portions 30 are shortened, in order to reduce the diameter of the transfer wheel 18, it is necessary to design the lever 28 so that it closes the exit ends of the guide channels 15 progressively rather than simultaneously.

As an alternative construction, the retention device 27 can be in the form of circular segments, which may be fork-shaped, corresponding in number to the number of groups of receiving groups 19 on the transfer wheel 18. These circular segments will be spring biased toward the axis of rotation of transfer wheel 18 and will be camed outwardly such that, during the indexing of the transfer wheel 18, the circular segment passing into the region of the exit ends of the guide channels 15 is caused to move outwardly against the spring bias to a position where it is aligned with the outer periphery of the transfer wheel and thus closes the guide channels 15. The caming arrangement will be such that, when the transfer wheel reaches its stationary position between steps, where the guide grooves will be aligned with the exit ends of the guide channels 15, the circular segment which has been cammed outwardly will be released so that it will move back to its retracted initial position under the influence of the spring bias. The retraction of the circular segment will, in the same manner as the pivoting of the lever 28 of the embodiment of FIGS. 1 and 2, permit a simultaneous transfer from all of guide channels 15 into the guide grooves 19.

As a further alternative to the fork-shaped retention device 27 of FIGS. 1 and 2, it is possible to employ a single arcuate segment which is rotatable in a direction which is opposite to the direction of rotation of the transfer wheel 18 by a distance, i.e. length of a circular arc, which corresponds to the length of the circular arc defined by a group of the receiving grooves 19. Such a single arcuate segment will then be rotated with transfer wheel 18, and in registration with its outer periphery, to a position beneath shaft 13 and the segment will then be rotated back to an initial position to permit the transfer from the guide channels 15 into the grooves 19.

During their movement with the transfer wheel 18, the cigarettes 11 are mechanically retained in the receiving grooves 19 by a wall 31 which is in the form of a circular arc extending from shaft 13 to funnel 21. However, it is to be noted that the receiving grooves 19 in transfer wheel 18 may be provided with apertures which are connected to a vacuum pump whereby the cigarettes will be held in the grooves 19 by suction. If the cigarettes are retained by suction in the grooves 19, it is possible to selectively interrupt the connection between the vacuum pump and the apertures in the grooves thereby allowing acceptable cigarettes to be released where they will fall into funnel 21 and retaining the defective cigarette in the grooves until a desired release point, either upstream or downstream of funnel 21, is reached. Obviously, if the cigarettes are held in grooves 19 by suction, it is possible to eliminate the ejectors 20.

Figure 3:
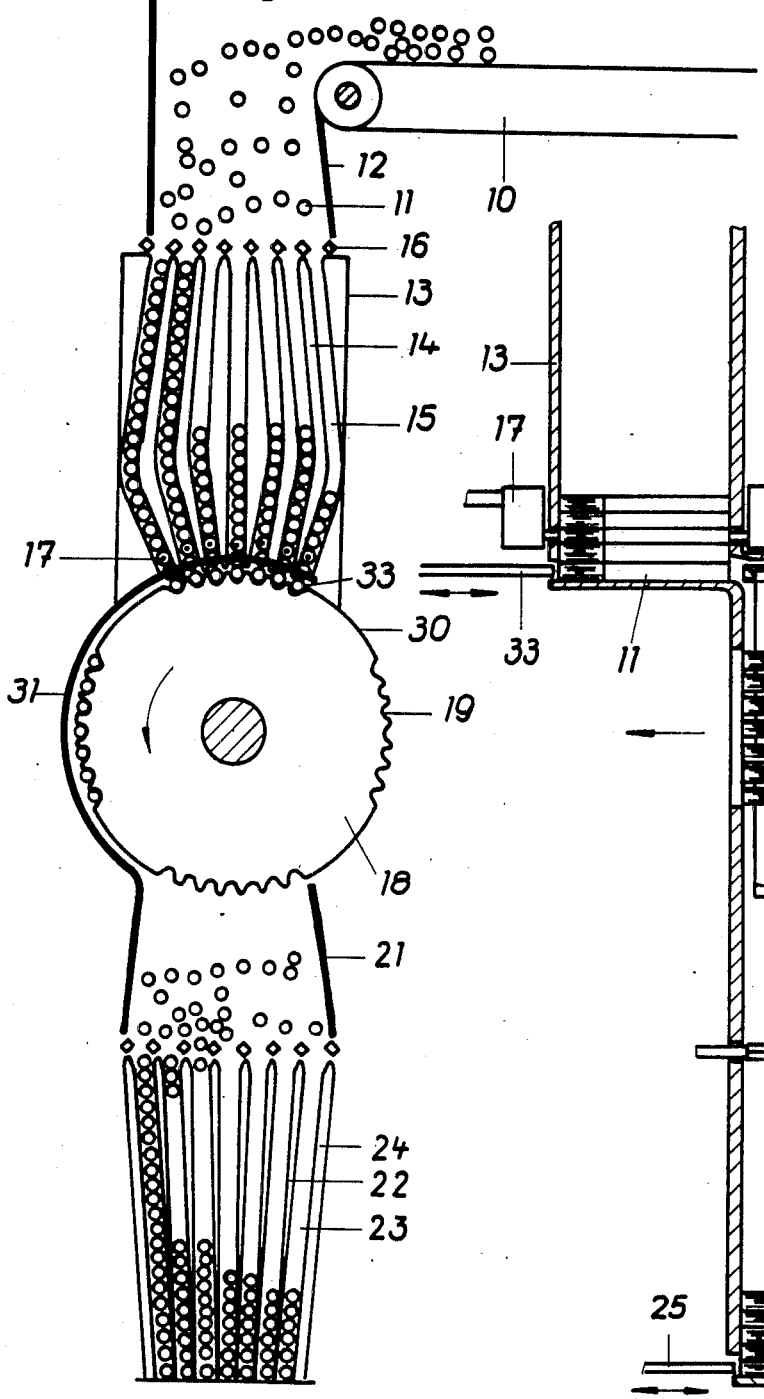
FIG. 3 is a view similar to FIG. 1 which depicts apparatus in accordance with a second embodiment of the present invention.
Figure 4:
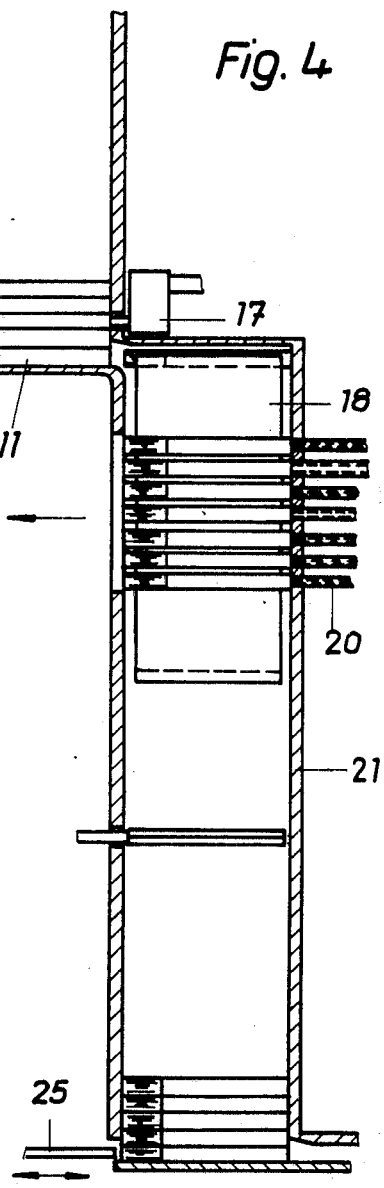
FIG. 4 is a cros-ssectional side elevation view of the apparatus represented by FIG. 3.

In the embodiment of FIGS. 3 and 4, the shaft 13 and the funnel 21 are not in vertical alignment as is the case in the embodiment of FIGS. 1 and 2. Thus, in the embodiment of FIGS. 3 and 4 there is an offset, which is preferably approximately the same distance as the length of the cigarettes being packaged, at the interface between the guide channels 15 and the transfer wheel 18. The shaft 13 is provided with a bottom which defines an arc corresponding to the arc defined by the bottoms of the grooves 19 in the transfer wheel 18. The shaft 13 is also open at the opposite sides adjacent the bottom thereof. A reciprocal slide 33, which also has an arcuate shape, is arranged to enter the base of shaft 13 through the open sides and to engage the lowermost cigarettes 11 in the guide channels 15 to push them into registered guide grooves 19 on the transfer wheel 18, this pushing action being to the right as the apparatus is depicted in FIG. 4. The embodiment of FIG. 4 has the advantage that, when the transfer wheel 18 is indexed, the cigarettes in the grooves 19 do not contact the lowermost cigarettes in the guide channels 15, the downwardly directed force being commensurate with the weight of the number of cigarettes in each guide channel. Other than not employing a retention device 27, the embodiment of FIGS. 3 and 4 includes the same components and operates in the same manner as the embodiment of FIGS. 1 and 2.

It is to be noted that the number of guide channels 15 in the shaft 13 may be made greater than the number of guide channels 23 in the shaft 24 in the interest of slower rotation of the transfer wheel 18. Also, if the funnel 21 has the appropriate width, two transfer wheels 18, which cooperate with respective shafts 13, can be employed. Use of a pair of transfer wheels 18 increases the time which is available for the quality control procedure, i.e. the examination of the cigarettes by means of sensors 17 and the subsequent ejection of defective cigarettes.

It is to be understood that the present invention is not limited to the embodiments described and shown herein, which are deemed to be merely illustrative of the best modes of carrying out the invention, and which are susceptible to modification as to form, composition and details of operation. The invention rather is intended to encompass all such modifications which are within its spirit and scope as defined by the claims.

What is claimed is:

1. Apparatus for delivering cigarettes from a source of loose cigarettes to a packaging machine comprising:

at least first means for receiving cigarettes from the cigarette source, said first receiving means including plural guide channels each having entrance and exit ends for stacking cigarettes one above the other and for distributing the received cigarettes in individual rows, said rows being spaced and having a width of one cigarette, said receiving means further including means for sensing the quality of a cigarette at a particular location in each of said channels and generating signals indicative of cigarettes of unacceptable quality;

means for arranging a group of cigarettes consisting of a preselected number of cigarettes with their axes parallel and defining a plane for subsequent feeding as a unit to a packaging machine; and means for transferring cigarettes from said receiving means to said arranging means, said transferring means including:

at least first rotatable drum means, said drum means having a generally cylindrical shape and being provided with plural spatially displaced groups of grooves on its curved side surface, said grooves each being sized and shaped to receive a single cigarette, said grooves in each group corresponding in number to the rows formed by said receiving means guide channels, said grooves in each group being spaced apart by distances which are commensurate with the distances between corresponding rows in said receiving means at the point of closest approach of said receiving means to said transferring means, funnel means located below and in communication with said drum means, said funnel means being positioned above and in communication with said arranging means, means for imparting stepwise rotational motion to said drum means to advance each group of grooves in increments from a top stationary position in alignment with said receiving means guide channel formed rows to a bottom stationary position in communication with said funnel means, means permitting delivery of the cigarettes from each of said receiving means rows which includes cigarettes substantially simultaneously into grooves of one of said group of grooves during the time between steps of motion of said drum means, means for retaining cigarettes in said grooves during rotational movement thereof between the said top position and the said bottom position of said drum means, said cigarettes being released to said funnel means when reaching said bottom position; and means for ejecting cigarettes of unacceptable quality from said drum means grooves when the drum means is stationary between the stepped motions, such that the ejected cigarettes will not be transferred to said arranging means.

2. The apparatus of claim 1 wherein said delivery permitting means comprises:

retention means, said retention means being movable between a first position where it prevents cigarette movement through the exit ends of said channels during movement of said drum means and a second position where it is displaced from the exit end of said guide channels by a distance greater than the maximum depth of said drum means grooves.

3. The apparatus of claim 2 wherein said retention means includes an arcuate portion having a diameter commensurate with the diameter of said drum means, said arcuate portion being generally in registration with the outer periphery with said drum means when said retention means is in said first position.

4. The apparatus of claim 2 wherein said retention means comprises a pivotable lever.

5. The apparatus of claim 3 wherein said retention means comprises a pivotable lever.

6. The apparatus of claim 1 wherein the length of the curved side surfaces of said drum means surface between each of said groups of grooves is substantially equal to the length of the curved side surface of said drum means encompassed by the groups of grooves.

7. The apparatus of claim 1 wherein said means for retaining comprises an arcuate guide member which extends along the periphery of said drum means between said receiving means and said arranging means.

8. The apparatus of claim 1 wherein, said funnel means includes a tubular receiver having an entrance end commensurate in size with a group of grooves on said drum means, cigarettes being discharged from said drum means grooves into said tubular receiver; and said arranging means includes means defining a plurality of slots, said slots communicating at their entrance ends with the exit end of said tubular receiver, said slots having closely spaced parallel discharge ends.

9. The apparatus of claim 8 further comprising:

means for sensing the quantity of cigarettes in said tubular receiving means.

10. The apparatus of claim 1 wherein said rotatable drum means and said receiving means are in alignment and the cigarettes travel in said receiving means and are delivered to said drum means grooves under the influence of gravity.

11. The apparatus of claim 1 wherein said receiving means and said drum means are offset relative to one another and wherein said delivery permitting means including slide means for moving the lowermost cigarettes in all of said rows in said receiving means axially into grooves on said drum means.

12. The apparatus of claim 1 wherein said retention means includes a plurality of arcuate members, said members being moveable radially with respect to the axis of said drum means, one of said arcuate members segments being associated with each group of drum means grooves and the length of said arcuate members being commensurate with the length of the arcuate segment of said drum means encompassed by each group of grooves.

13. The apparatus of claim 2 wherein said retention means includes an arcuate member which is moveable with and in the opposite direction of said drum means, the movement of said arcuate member in the said opposite direction occurring subsequent to establishment of registration between said drum means grooves and said guide channels.

14. The apparatus of claim 1 wherein said retaining means comprises:

means for selectively applying low pressure to the base of said drum means grooves.

15. The apparatus of claim 1 wherein said means for retaining comprises means for selectively applying low pressure to the base of said drum means grooves whereby cigarettes may be retained in said grooves by suction and wherein said ejection means comprises means responsive to the signals provided by said means for sensing the quality of a cigarette for selectively terminating the application of low pressure to said grooves whereby cigarettes of unacceptable quality will be released therefrom.

16. The apparatus of claim 1 wherein said arranging means includes:

a tubular receiver having an entrance end commensurate in size with said peripheral region on said drum means, cigarettes being discharged from said drum means grooves into said tubular receiver; and means defining a plurality of slots, said slots communicating at their entrance ends with the exit end of said tubular receiver, said slots having closely spaced parallel discharge ends.

17. The apparatus of claim 16 wherein said receiving means includes plural guide channels wherein said rows are individually formed, said channels each having an entrance end and an exit end, and wherein said delivery permitting means comprises:

retention means, said retention means being moveable between a first position where it prevents cigarette movement through the exit ends of said channels during movement of said drum means and position where it is displaced from the exit end of said guide channels by a distance greater than the maximum depth of said drum means grooves.

18. The apparatus of claim 17 wherein said retention means includes an arcuate portion having a diameter commensurate with the diameter of said drum means, said arcuate portion being generally in registration with the outer periphery with said drum means when said retention means is in said first position.

* * * * *